US006062453A

United States Patent [19]

Murray et al.

[11] Patent Number: 6,062,453

[45] Date of Patent: May 16, 2000

[54] ACTIVE DISK GUIDE

[75] Inventors: Thomas Alan Murray; Ralph Damon Ring, both of Akron, Ohio

[73] Assignee: The Goodyear Tire & Rubber Company, Akron, Ohio

[21] Appl. No.: 09/171,666

[22] PCT Filed: Jul. 25, 1996

[86] PCT No.: PCT/US96/12178

§ 371 Date: Oct. 20, 1998

§ 102(e) Date: Oct. 20, 1998

[87] PCT Pub. No.: WO98/04488

PCT Pub. Date: Feb. 5, 1998

[51] Int. Cl.[7] ..... B65H 43/00; B65G 39/16

[52] U.S. Cl. ..... 226/19; 226/21; 226/3; 198/807; 198/810.03

[58] Field of Search ..... 226/3, 19, 20, 226/21; 198/807, 810.03, 840

[56] References Cited

U.S. PATENT DOCUMENTS

| | | | |
|---|---|---|---|
| 3,225,988 | 12/1965 | Drenning | 226/19 |
| 3,244,418 | 4/1966 | Henderson . | |
| 3,273,696 | 9/1966 | Thurston . | |
| 3,300,114 | 1/1967 | Jacobsen | 226/19 X |
| 3,731,864 | 5/1973 | Ott, Jr. | 226/19 |
| 3,915,282 | 10/1975 | Remensperger . | |
| 4,155,496 | 5/1979 | Houck | 226/21 X |
| 5,244,435 | 9/1993 | Billett . | |
| 5,407,190 | 4/1995 | Hehn . | |

FOREIGN PATENT DOCUMENTS

| | | |
|---|---|---|
| 0 110 670 | 6/1984 | European Pat. Off. . |
| 1441479 | 5/1966 | France . |
| 80 25 417 U | 10/1981 | Germany . |
| 954976 | 4/1959 | United Kingdom . |

*Primary Examiner*—Michael R. Mansen
*Attorney, Agent, or Firm*—Frederick K Lacher

[57] ABSTRACT

A conveyor system and method for steering and shifting an associated strip component to a desired transverse position includes a sensor for sensing the transverse position of the associated strip component, a shaft rotatable about an axis generally perpendicular to the direction of motion of the strip component, and a plurality of guide disks rotatably mounted on side by side sleeve bearings which are keyed to the shaft. Each of the guide disks has an inner circumferential bearing surface and an outer circumferential surface for engagement with the bottom surface of the associated strip component. Each of the guide disks is canted at a fixed angle with respect to the shaft axis. Additionally the shaft is axially movable. The conveyor system includes an apparatus for simultaneously moving the shaft axially and rotating the shaft about the shaft axis to change the angle at which the guide disks engage the strip material and shift the strip material in response to signals from the sensor as to the location of the strip component.

11 Claims, 3 Drawing Sheets

ACTIVE DISK GUIDE

TECHNICAL FIELD

The present invention concerns the art of methods and apparatuses for guiding strip components on a conveyor system, arid more specifically to methods and apparatuses for electronically sensing and dynamically shifting and steering the strip components to a desired transverse position.

BACKGROUND ART

In the past, when a strip component was conveyed by a conveyor, the conveyor system either did not guide the component to align it with the conveyor, or the conveyor system had guides that kept the component aligned with the conveyor. If the component was not guided, it was possible that the component would not be aligned with the conveyor when the component reached its destination. If physical guides such as side guide rails were used, the sides of the component were subject to damage due to contact with the guide rails.

Although guiding a strip component carried by a conveyor is not the same as guiding a belt, a belt roller, described in U.S. Pat. No. 3,273,696 to Thurston, utilized an assembly of angled disks rotatably mounted on a rotatable shaft to maintain the position of a belt. When the shaft was rotated, the angle of engagement of the disks with the belt surface was changed. One embodiment of the invention used a sensing device to measure belt displacement. However, the problem was that this assembly of angled disks was unable to provide an instantaneous lateral adjustment. Lateral movement of the assembly was not necessary because the belt was wrapped around a significant portion of the disks which allowed more contact time with the belt to steer the belt. In a conveyor system for strip components, such an apparatus would contact the strip component to be guided along a small portion of each disk, thereby reducing the contact time for guiding and seriously limit the steering capability of the system.

In most other guiding systems the sheet or strip to be guided was required to be in web tension which is not desirable especially with extruded unreinforced sheets or strips of elastomeric material used in the manufacture of tires. Guidance systems also required extensive space consuming equipment whereas in tire building equipment space is limited.

Applicants recognized the need for a steering apparatus that could provide an instantaneous shifting adjustment as well as a prolonged steering action without using guide rails that could damage the strip component being conveyed.

The present invention contemplates a new and improved guiding system which is compact, simple in design, effective in use, and solves the problem by overcoming the foregoing difficulties and others while providing better and more advantageous overall results.

DISCLOSURE OF INVENTION

In accordance with the present invention, a new and improved guiding system is provided which optically senses and dynamically steers strip components to a desired position.

More particularly, in accordance with the present invention, a conveyor system for steering an associated strip or sheet component to a desired transverse position is provided that has a conveyor apparatus for conveying the associated strip component from an initial longitudinal and transverse position to a desired transverse position, the conveyor apparatus conveying the associated strip component in a longitudinal direction; a sensor for sensing the location of the associated component relative to the conveyor apparatus; a shaft being located between the conveyor apparatus and the desired position, the shaft being rotatable about an axis and positioned with the axis perpendicular to the direction of motion of the conveyor apparatus; and a plurality of guide disks rotatably mounted about the shaft, each of the guide disks having an inner circumferential surface and an outer circumferential surface, the associated component passing over the outer circumferential surface, the inner circumferential surface rotatable on the shaft, each of the guide disks having a diametrical axis, each of the guide disks being mounted such that each of the diametrical axes are at a fixed angle with respect to the axis of the shaft; characterized in that the shaft is axially movable with the conveyor system having steering apparatus for moving the shaft axially and rotating the shaft about the shaft axis in response to the location of the associated strip or sheet component as sensed by the sensor.

According to one aspect of the present invention, a method of steering an associated component from an initial transverse position to a desired transverse position with a conveyor system having a conveyor apparatus, a sensor, a guide disk control, a shaft, a plurality of guide disks each rotatably mounted at a fixed angle about the shaft, is provided having the steps of sensing the location of the associated component with the sensor; transmitting the location of the associated component from the sensor to the guide disk control; and rotating the shaft to an angular position where the guide disks are tilted at a predetermined angle to the surface of the associated component in response to the signal from the guide disk control, thereby further aligning the associated component with the desired transverse position; characterized in that the method further includes the step of immediately moving the shaft axially to align the associated component with the desired position in response to a signal from the guide disk control, thereby aligning the associated component with the desired transverse position.

According to another aspect of the present invention, a disk guide apparatus for steering an associated component to a desired transverse position is provided that has a sensor for sensing the location of the associated component; a shaft located below the sensor and being rotatable about a shaft axis; a plurality of guide disks rotatably mounted about the shaft, each of the guide disks having an inner circumferential surface and an outer circumferential surface, the associated component passing over the outer circumferential surface, the inner circumferential surface contacting the shaft, each of the guide disks having a diametrical axis, each of the guide disks being mounted such that each of the diametrical axes are at a fixed angle with respect to the shaft axis; the disk guide apparatus characterized in that the shaft is axially movable and the disk guide apparatus includes a steering apparatus for moving the shaft axially and rotating the shaft about the axis in response to the location of the associated component as sensed by the sensor.

One advantage of the present invention is that axial movement of the shaft provides instantaneous lateral adjustments in the position of the strip component.

Another advantage of the present invention is that the component is guided from the bottom of the component only, thereby not damaging the sides of the component.

Another advantage of the present invention is that the position of the component is determined without contacting and damaging the edges of the component.

Another advantage of the present invention is that a continuous component may be guided without damaging the component.

Another advantage of the present invention is that the shaft turning apparatus is compact and provides both steering and shifting of the disk guide.

Another advantage of the present invention is that the disk guide may guide a series of individual components.

Another advantage of the present invention is that it is operable with a minimum web tension of the strip or sheet component.

Still other benefits and advantages of the invention will become apparent to those skilled in the art to which it pertains upon a reading and understanding of the following detailed specification.

BRIEF DESCRIPTION OF DRAWINGS

The invention may take physical form in certain parts and arrangement of parts, a preferred embodiment of which will be described in detail in this specification and illustrated in the accompanying drawings which form a part hereof and herein.

DETAILED DESCRIPTION OF THE INVENTION

Figure 1:
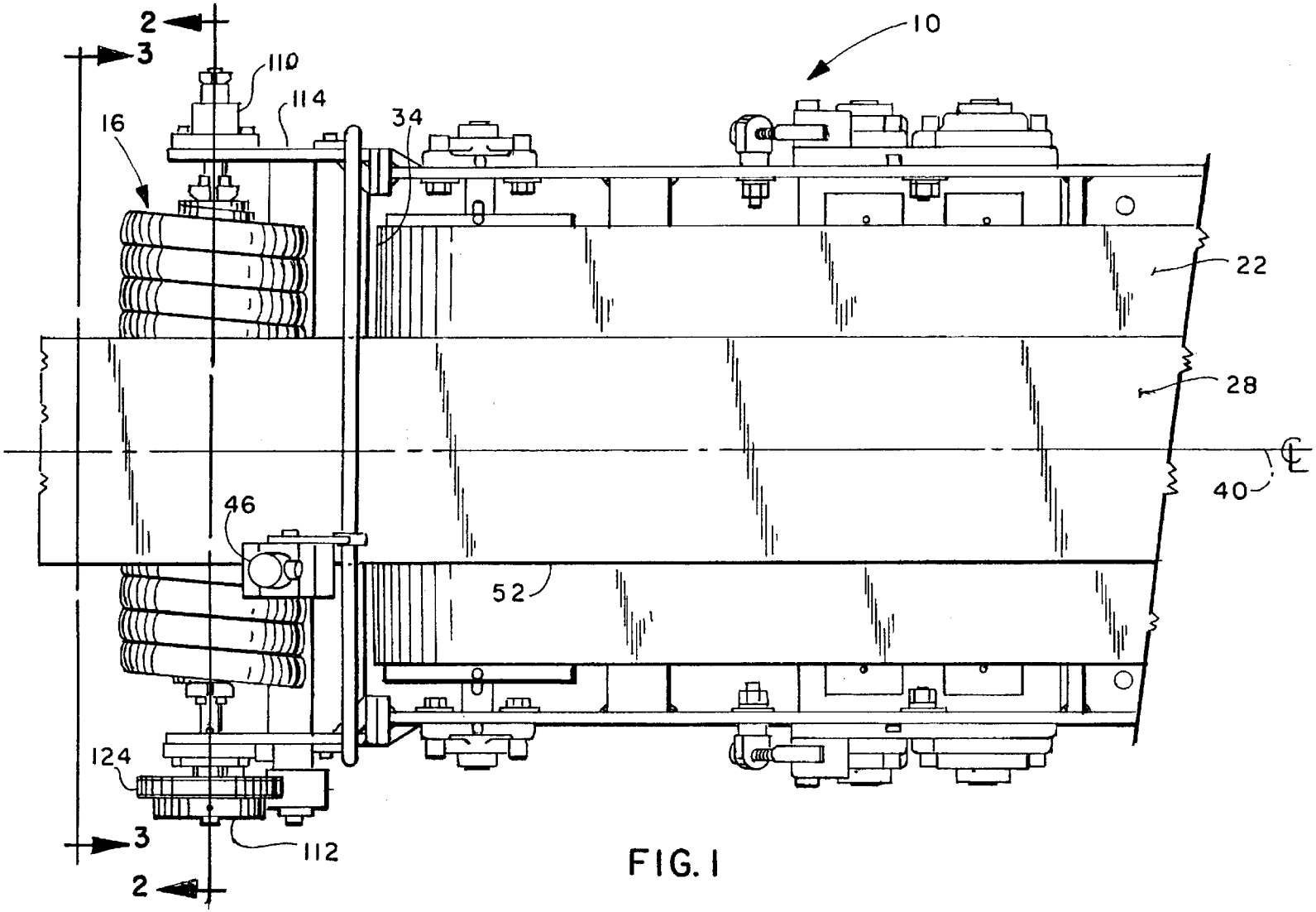
FIG. 1 is a plan view of a portion of a conveyor system containing an active disk guide embodying the invention for steering an associated strip component.

Referring now to the drawings wherein the showings are for purposes of illustrating a preferred embodiment of the invention only and not for purposes of limiting the same, FIG. 1 shows a plan view of a conveyor system 10 that includes an active disk guide 16. The 10 conveyor system preferably has a conveyor belt 22 to convey a strip or sheet component 28 such as a strip or sheet of rubber from an extruder to an applicator. The active disk guide 16, located beyond an end 34 of the conveyor belt 22, centers the component 28 along a center line 40 of the conveyor belt 22 by an optical edge sensor 46. As the component 28 is conveyed along the conveyor belt 22, the optical sensor 46 senses the position of an edge 52 of the component relative to the conveyor. Preferably, the optical sensor 46 is positioned to detect whether the edge 52 of the component 28 is outside a predetermined position that is based upon the width of the component. The optical sensor 46 is connected to a control apparatus, which operates the active disk guide 16. The active disk guide 16 may be used to steer the component 28, thereby aligning the component with the center line 40 of the conveyor belt 22. This edge guiding may be replaced by a center guiding system which requires another optical sensor at an opposite edge of the component 28.

Figure 2:
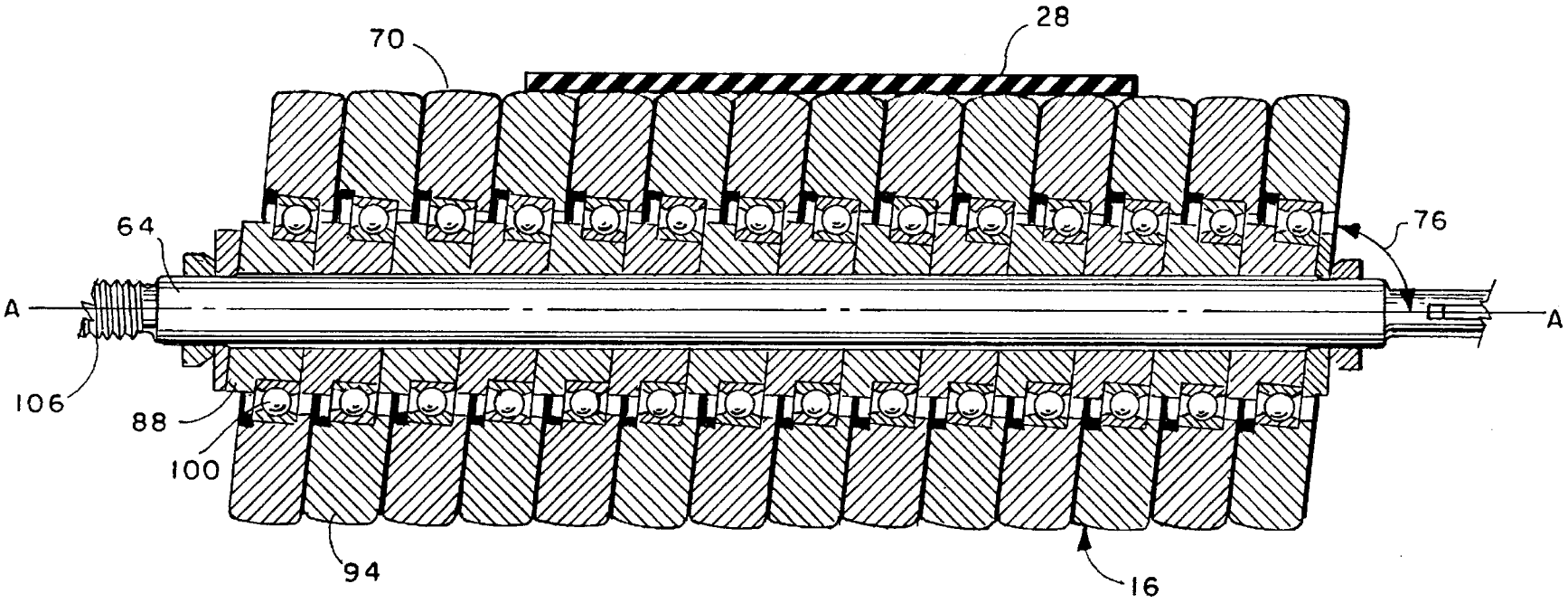
FIG. 2 is a cross sectional view of the active disk guide along line 2—2 of FIG. 1; and, FIG. 3 is an elevation of the active disk guide taken along lines 3—3 of FIG. 1.

As shown in FIG. 2 the active disk guide 16 includes a shaft 64 and a series of disks 70. Each of the disks 70 is rotatably mounted on an inner bearing 88 and tilted or canted at an angle 76 slightly less than 90 degrees. In the preferred embodiment of the present invention, the disks 70 are tilted at an angle of 85 degrees with respect to the axis A—A of the shaft 64, although a wider range of angles between 30 degrees and 89 degrees may also be employed. When the shaft 64 is rotated, the orientation of the disks 70 changes, ranging from being tilted to the right as shown in FIG. 2 to being tilted in the opposite direction. The disks 70 maintain their fixed angle 76 with respect to the shaft axis A—A, but the orientation of the disks changes as the shaft is rotated about its axis A—A. Each of the disks 70 preferably includes an inner bearing 88 and an outer disk 94. The inner bearing 88 is mounted on the shaft 64 for rotation with the shaft as by keys (not shown), and the outer disk 94 is rotatably supported on the inner bearing 88. The bearing 88 permits the free and independent rotation of the outer disk 94 about the shaft 64.

Figure 3:
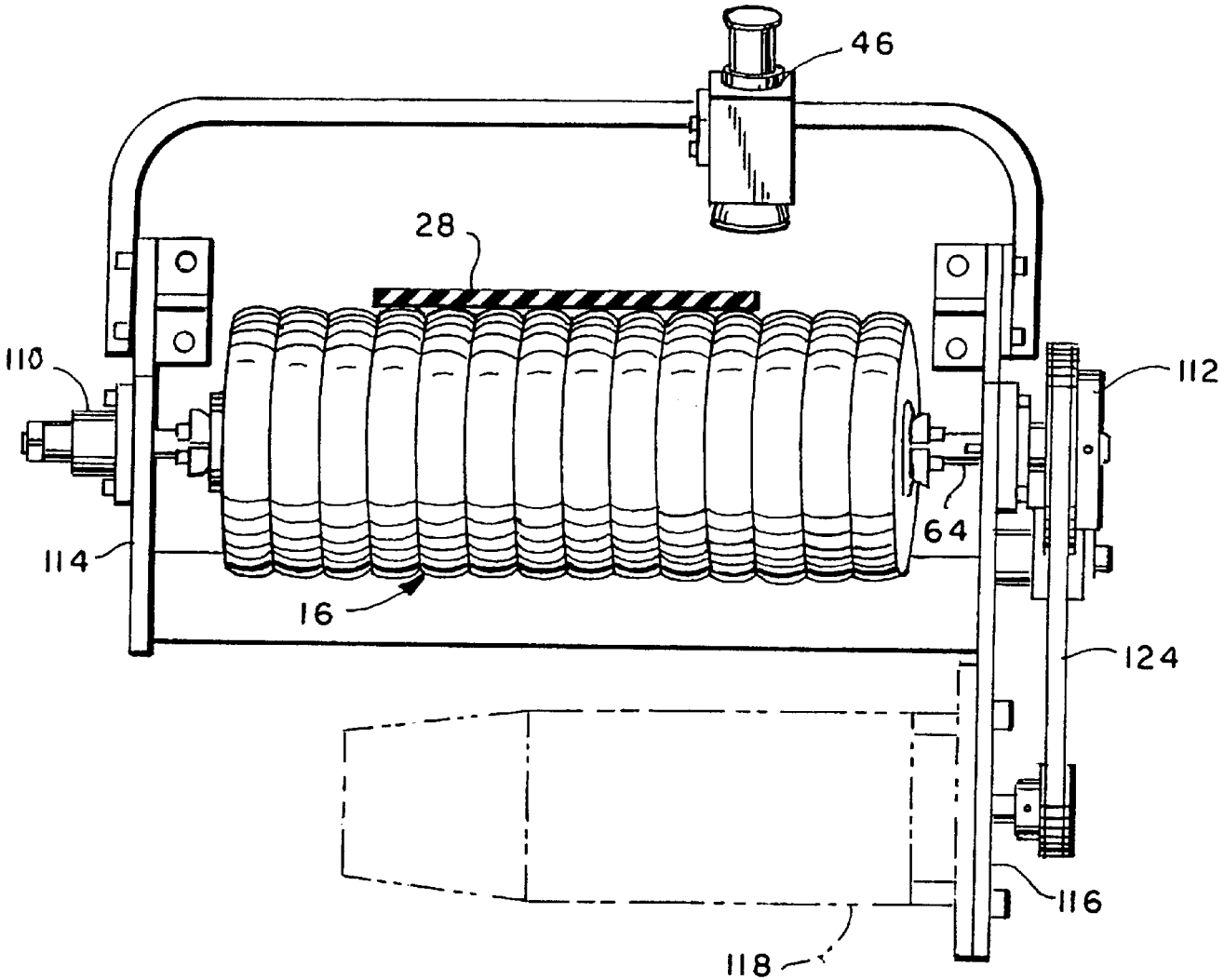

With respect to FIGS. 2 and 3, one end 106 of the shaft 64 is preferably threaded. The threaded end 106 is screwed into a stationery threaded bushing 110 mounted on a frame member 114. A servo motor 118 which is also mounted on another frame member 116 has a pulley for moving a belt 124 wrapped around a second pulley 112 mounted on the shaft 64. Rotation of the motor 118 causes rotation of the shaft 64 changing the orientation of the disks 70 and causes the strip component 28 to be steered. Because the shaft 64 is threaded in the bushing 110, rotation of the pulley 112 also causes the shaft to be moved in an axial direction the distance the threaded end 106 is moved due to rotation of the pulley. The threads at the threaded end 106 of the shaft 64 are preferably at a one degree pitch. The shaft 64 preferably begins at a neutral position and rotates about the axis A—A 90 degrees in each direction, thereby causing the disk guide 16 to go from a neutral position to full steer right or full steer left. Turning of the shaft 64 over an angle of 90 degrees also moves the shaft axially one quarter of an inch because the shaft end 106 is threaded in the bushing 110. The immediate axial movement of the shaft 64 enables the strip component 28 to be moved transversely as the strip component passes over the active disk guide 16. Servo motor 118 acts in response to signals from the control apparatus based upon the location of the component 28 as determined by the optical sensor 46.

Although a conveyor belt 22 is illustrated in FIG. 1, the active disk guide 16 may also be used with a conveyor system 10 that consists solely of rollers that allows the strip component 28 to roll with the aid of gravity, or any other suitable conveyor system.

While a certain representative embodiment and details have been shown for the purpose of illustrating the invention, it will be apparent to those skilled in the art that various changes and modifications may be made therein without departing from the scope of the invention.

Having thus described the invention, it is now claimed:

1. A conveyor system 16 for conveying and steering an associated strip component 28 comprising conveying means 22 for carrying said component 22 longitudinally of said system 10, an active disk guide 16 downstream of said conveying means 22 for supporting and steering said component characterized by a shaft 64 having a plurality ot guide disks 70 rotatably mounted on said shaft 64 and canted at an angle 76 to the axis A—A of said shaft 64, means for rotating said shaft 64 to select the angle 76 of engagement of said disks 70 with said component 28 and means for moving said shaft 64 axially in addition to said means for rotating said shaft 64 to provide immediate shifting of said component 28 in a desired direction.

2. The conveyor system of claim 1 further characterized by said means for moving said shaft 64 axially includes a threaded portion 106 on said shaft 64 engageable with a stationary threaded bushing 110 for moving said shaft 64 axially upon rotation of said shaft 64.

3. The conveyor system of claim 1 further characterized by a sensor 46 for sensing the location of said associated components 28 relative to said conveying means 22 and guide disk control means 58 for controlling axial and rotational movement of said shaft 64 connected to said sensor 46 and to said means 118 for rotating said shaft 64.

4. The conveyor system of claim 3 further characterized by said sensor 46 being positioned adjacent the exit end 34 of said conveying means 22.

5. The conveyor system of claim 4 further characterized by said sensor 46 being located for sensing the position of an edge 52 or said strip component 28.

6. The conveyor system of claim 1 further characterized by said conveying means 22 including a conveyor belt 22 for carrying said strip component 28.

7. The conveyor system of claim 1 further characterized by said guide disks 70 being canted to the axis A—A of said shaft 64 at an angle 76 of between 30 degrees and 89 degrees.

8. The conveyor system of claim 7 further characterized by said angle 76 being about 85 degrees.

9. A method of conveying and steering an associated strip component 28 from a transverse position on a conveying means 22 to a predetermined transverse position on an active guide disk 16 having a shaft 64 with a plurality of guide disk, 70 rotatably mounted on said shaft 64 and canted at an angle 76 to the axis A—A of said shaft 64 characterized by (a) rotating said shaft 64 to select the desired angle 76 of engagement of said disks 70 with said component 28 and (b) simultaneously moving said shaft 64 axially to provide immediate steering of said component 28 in the desired direction.

10. The method of claim 9 wherein said transverse position on said conveying means 2 is determined by a sensor 46 further characterized by rotating said shaft 64 in response to signals from said sensor 46 as to the transverse position of said strip component 18 on said conveying means.

11. The method of claim 9 wherein said shaft 62 has a threaded portion 106 engageable with a stationary threaded bushing 110 for moving said shaft 64 axially upon rotation of said shaft 64 further characterized by rotating said shaft 64 a predetermined single to provide the desired in axial movement of the shaft 64 in addition to the desired angle 76 of engagement.

* * * * *

UNITED STATES PATENT AND TRADEMARK OFFICE

CERTIFICATE OF CORRECTION

PATENT NO. : 6,062,453
DATED : May 16, 2000
INVENTOR(S) : Murray et al.

It is certified that error appears in the above-identified patent and that said Letters Patent is hereby corrected as shown below:

Column 4,
Line 50, substitute numeral -- 28 -- for "22"
Line 53, substitute -- of -- for "ot"

Column 5,
Line 10, substitute -- of -- for "or"
Line 23, after "disk" delete the comma Column 6,
Line 9, substitute numeral -- 22 -- for numeral "2"
Line 15, substitute numeral -- 64 -- for numeral "62"
Line 19, substitute -- angle -- for "single"

Signed and Sealed this

Thirteenth Day of November, 2001

*Attest:*

Nicholas P. Godici

NICHOLAS P. GODICI
*Acting Director of the United States Patent and Trademark Office*

*Attesting Officer*